US010641216B2

(12) United States Patent
Kim et al.

(10) Patent No.: US 10,641,216 B2
(45) Date of Patent: May 5, 2020

(54) STRUCTURE FOR PREVENTING FREEZING OF BLOW-BY GAS IN INTAKE MANIFOLD

(71) Applicant: HYUNDAI KEFICO CORPORATION, Gunpo, Gyeonggi-Do (KR)

(72) Inventors: Min Ki Kim, Gyeonggi-do (KR); Chan Karam Na, Seoul (KR); Hyung Wook Kim, Gyeonggi-Do (KR)

(73) Assignee: HYUNDAI KEFICO CORPORATION, Gunpo-Si, Gyeonggi-Do (KR)

( * ) Notice: Subject to any disclaimer, the term of this patent is extended or adjusted under 35 U.S.C. 154(b) by 0 days.

(21) Appl. No.: 16/234,198

(22) Filed: Dec. 27, 2018

(65) Prior Publication Data

US 2019/0203682 A1 Jul. 4, 2019

(30) Foreign Application Priority Data

Dec. 28, 2017 (KR) ..... 10-2017-0182830

(51) Int. Cl.
*F02M 35/10* (2006.01)
*F01M 13/00* (2006.01)

(52) U.S. Cl.
CPC ..... *F02M 35/10268* (2013.01); *F01M 13/00* (2013.01); *F02M 35/1036* (2013.01); (Continued)

(58) Field of Classification Search
CPC ..... F02M 35/10268; F02M 35/10222; F02M 35/1036; F01M 2013/0038; F01M 13/00; F01M 13/0011; F01M 2013/0027
See application file for complete search history.

(56) References Cited

U.S. PATENT DOCUMENTS 6,062,206 A * 5/2000 Nelson ..... F01M 13/00 123/573
7,017,562 B2 3/2006 Jeon
(Continued)

FOREIGN PATENT DOCUMENTS

JP 04-107432 A 4/1992
JP 5321852 B2 10/2013
(Continued)

OTHER PUBLICATIONS

Notice of Allowance issued in corresponding Russian Patent Application No. 2018146866 dated Aug. 29, 2019 (15 pages).

*Primary Examiner* — Jacob M Amick
(74) *Attorney, Agent, or Firm* — Mintz Levin Cohn Ferris Glovsky and Popeo, P.C.; Peter F. Corless

(57) ABSTRACT

The present disclosure relates to a structure for preventing freezing of moisture contents within a blow-by gas in an intake manifold, capable of preventing the blow-by gas introduced into the manifold from freezing even under a low temperature environment. The structure includes a positive crankcase ventilation (PCV) channel into which the blow-by gas is introduced, an insulating member having a first side and a second side that communicate with each other and inserted into the PCV channel, and a PCV nipple having a first end and a second end that communicate with each other and inserted into the insulating member to guide the blow-by gas. The insulating member includes an outer peripheral surface in contact with an inner peripheral surface of the PCV channel and an inner peripheral surface in contact with an outer peripheral surface of the PCV nipple to surround the peripheral surface of the PCV nipple.

17 Claims, 6 Drawing Sheets

(52) U.S. Cl.
CPC ..... *F02M 35/10222* (2013.01); *F01M 2013/0038* (2013.01)

(56) References Cited

U.S. PATENT DOCUMENTS

| | | | |
|---|---|---|---|
| 8,505,519 | B2 | 8/2013 | Park |
| 8,517,002 | B2 | 8/2013 | Yang |
| 9,316,131 | B2 | 4/2016 | Rollinger et al. |
| 9,714,590 | B2 | 7/2017 | Rollinger et al. |
| 2006/0005820 | A1 | 1/2006 | Jeon |
| 2012/0132158 | A1 | 5/2012 | Park |
| 2012/0138030 | A1 | 6/2012 | Yang |
| 2012/0328424 | A1 | 12/2012 | Berger et al. |
| 2014/0081551 | A1 | 3/2014 | Rollinger et al. |
| 2016/0230624 | A1 | 8/2016 | Rollinger et al. |

FOREIGN PATENT DOCUMENTS

| | | | |
|---|---|---|---|
| KR | 10-2007-0002939 | A | 1/2007 |
| KR | 10-2011-0042807 | A | 4/2011 |
| KR | 10-2012-0026768 | A | 3/2012 |
| KR | 10-2013-0057189 | A | 5/2013 |
| RU | 2620901 | C2 | 5/2017 |

* cited by examiner

STRUCTURE FOR PREVENTING FREEZING OF BLOW-BY GAS IN INTAKE MANIFOLD

CROSS-REFERENCE TO RELATED APPLICATION

This application claims priority to and the benefit of Korean Patent Application No. 10-2017-0182830, filed on Dec. 28, 2017, the disclosure of which is incorporated herein by reference in its entirety.

BACKGROUND

1. Technical Field

The present disclosure relates to a structure for preventing freezing of a blow-by gas in an intake manifold, which is capable of preventing moisture contents in the blow-by gas introduced into the manifold from freezing even under a low temperature environment.

2. Related Art

Generally, an intake manifold is provided in a vehicle to uniformly distribute air or a mixed gas to cylinders of an engine. The intake manifold includes a plenum chamber configured to temporarily store a mixed gas supplied to a lower side thereof, a throttle body disposed to communicate with one side of the plenum chamber to allow the mixed gas that passes through a carburetor to flow, an intake runner configured to guide the mixed gas stored in the plenum chamber to flow into each cylinder, and the like.

In the mixed gas supplied to each cylinder through the intake runner, a gas discharged from a cylinder head of the engine through a gap between a cylinder and a piston during a compression stroke and an expansion stroke is referred to as a blow-by gas. The blow-by gas is discharged from the cylinder head of the engine, passes through a discharge passage of a cylinder block and a head cover of the cylinder head through a positive crankcase ventilation (PCV) system, and then is recycled to the intake manifold through a separate PCV hose.

The PCV hose is connected to a PCV nipple installed in a surge tank, the blow-by gas is introduced into a PCV chamber through the PCV nipple, and the blow-by gas introduced into the PCV chamber is discharged to the plenum chamber and is subsequently mixed with a newly supplied mixed gas and distributed to each intake runner.

Under a condition in which the ambient temperature is below a freezing temperature of water as in cold regions or during a winter season, while moisture contained in the blow-by gas is introduced into an intake side, a freezing phenomenon, in which condensed water freezes in a passage or the like of the PCV nipple, occurs due to a temperature difference with the outside air. When such a freezing phenomenon occurs, the PCV nipple is clogged and fail to operate normally. Thus, the blow-by gas may not be discharged from the inside of the engine to the surge tank and may be blocked. As a result, the blow-by gas increases pressure inside the engine to adversely affect engine sealing, resulting in leakage at a sealing joint.

SUMMARY

The present disclosure has been made to solve the above problems and is directed to providing a structure for preventing freezing of moisture contents within a blow-by gas in an intake manifold that is capable of preventing the blow-by gas introduced into the manifold from freezing under a low temperature environment.

According to an exemplary embodiment of the present disclosure, a structure for preventing freezing of a blow-by gas is provided. The structure may include a positive crankcase ventilation (PCV) channel into which the blow-by gas is introduced, an insulating member having a first side and a second side that communicate with each other and inserted into the PCV channel, and a PCV nipple having a first end and a second end that communicate with each other and inserted into the insulating member to guide the blow-by gas. The insulating member may include an outer peripheral surface in contact with an inner peripheral surface of the PCV channel and an inner peripheral surface in contact with an outer peripheral surface of the PCV nipple to surround the peripheral surface of the PCV nipple.

The PCV nipple may include a gas inflow portion configured to be connected to a PCV hose that is connected to a cylinder head of an engine and through which the blow-by gas is introduced. The PCV nipple may also include a gas ejection portion through which the blow-by gas introduced through the gas inflow portion is discharged. In particular, an inner diameter of the gas ejection portion may be smaller than an inner diameter of the gas inflow portion. The PCV nipple may be gradually inclined in a downward direction from the gas inflow portion toward the gas ejection portion.

The insulating member may include an insertion portion having a first end in contact with an outer peripheral portion of the gas ejection portion, a connection portion having a first end connected to the second end of the insertion portion and a second end that extends in a downward direction, and a discharge portion having a first end connected to the second end of the connection portion and a second end that extends in the downward direction and through which the blow-by gas discharged through the gas ejection portion is discharged. The connection portion may include a curved inner peripheral surface.

The insertion portion may include a plurality of support protrusions formed along an inner peripheral portion thereof. An edge region in a downward direction of the discharge portion may include a round shape. A stepped portion may be formed in the insulation member between an inner peripheral surface of the insertion portion and an inner peripheral surface of the connection portion to support the gas ejection portion of the PCV nipple. The insertion portion may be inclined at an angle of about 91° to about 105° from the discharge portion.

An inlet side of the PCV channel, into which the blow-by gas is introduced, may include a fixing protrusion which extends in an outward direction from an outer side surface thereof, and the PCV nipple may include a fixing plate which extends in a radially outward direction from a middle region thereof to be mated with the fixing protrusion. An inner diameter of the fixing protrusion may be greater than an outer diameter of the gas ejection portion. The fixing protrusion and the fixing plate may be coupled to each other by bolt coupling, vibration welding, or spin welding.

A coupling protrusion configured to fix the insulating member may be formed on an inner peripheral surface of the fixing protrusion, and a coupling groove may be formed at a position that corresponds to the coupling protrusion in a side surface of the insulating member. The discharge portion may include a latch protrusion which extends in an outward direction from an outer peripheral surface thereof and is disposed around an outlet side of the PCV channel through which the blow-by gas is discharged. The insulating member may be coupled inside the PCV channel by a vibration welding method.

The PCV channel may further include a guide panel which is formed at a position adjacent to the new air inlet in the intake manifold and extends from an inner side surface of the new air inlet in a downward direction to be spaced apart from an end of the insulating member. The guide panel may be inclined at an angle of about 1° to about 30° from the inner side surface of the new air inlet in the downward direction of the end of the insulating member.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION

The advantages, features, and methods of achieving the advantages and features of the present exemplary embodiments will be made apparent to and comprehended by those skilled in the art based on the exemplary embodiments, which will be described below in detail, together with the accompanying drawings. The present disclosure is not limited to the following exemplary embodiments but is embodied in various forms. The present exemplary embodiments will make the disclosure of the present disclosure complete and allow those skilled in the art to completely comprehend the scope of the present disclosure. The present disclosure is only defined within the scope of the accompanying claims. Terms used in this specification are to describe the exemplary embodiments and are not intended to limit the present disclosure.

As used herein, the singular forms "a," "an," and "the" are intended to include the plural forms as well, unless the context clearly indicates otherwise. It will be further understood that the terms "comprises," "comprising," "includes," and/or "including," when used herein, specify the presence of stated steps, operations, elements and/or components, but do not preclude the presence or addition of one or more other steps, operations, elements, components and/or groups thereof. It will be further understood that the terms "comprises" and/or "comprising," or "includes" and/or "including," when used in this specification, specify the presence of stated elements, steps, operations, and/or components, but do not preclude the presence or addition of one or more other elements, steps, operations, and components.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Figure 1:
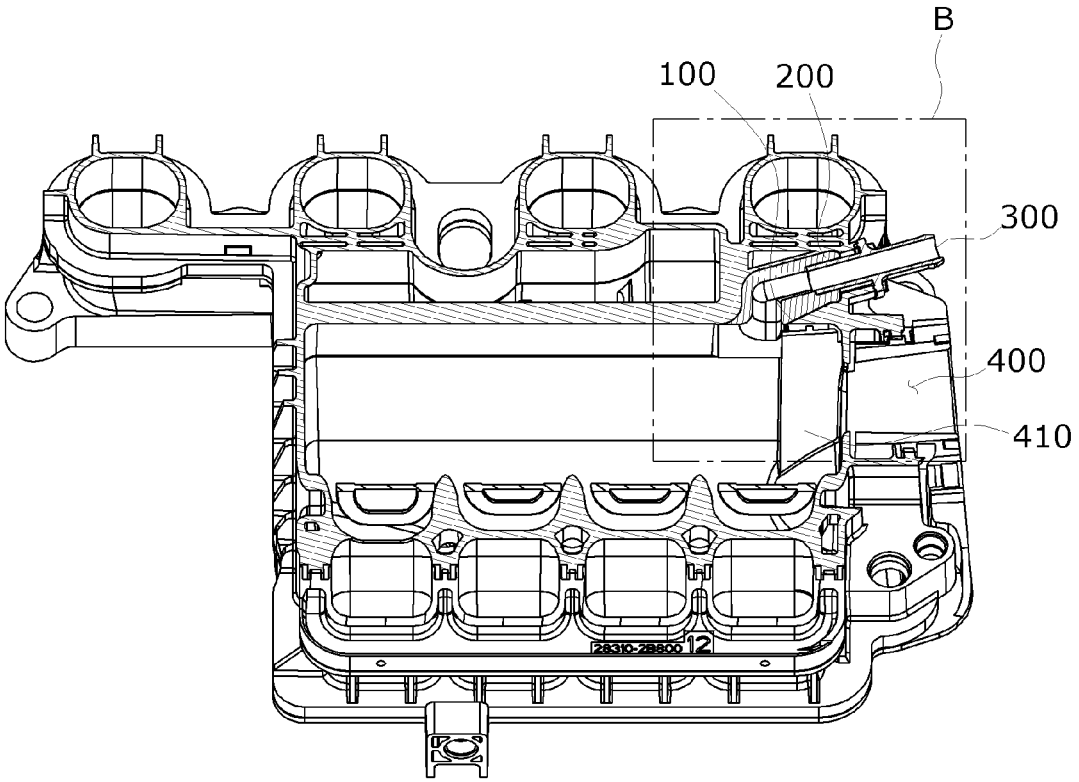
FIG. 1 is a cross-sectional view illustrating a structure for preventing freezing of a blow-by gas in an intake manifold according to an exemplary embodiment of the present disclosure.
Figure 2:
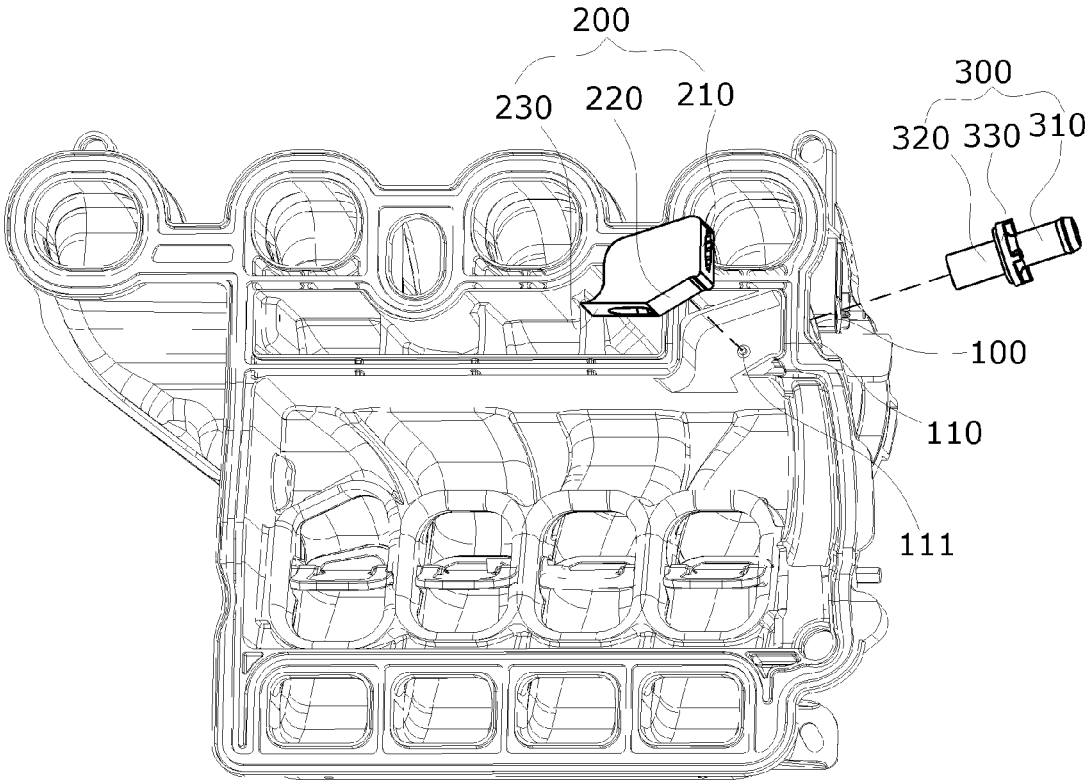
FIG. 2 is an exploded perspective view illustrating a mounting structure of an insulating member and a positive crankcase ventilation (PCV) nipple according to the exemplary embodiment of the present disclosure.
Figure 3A:
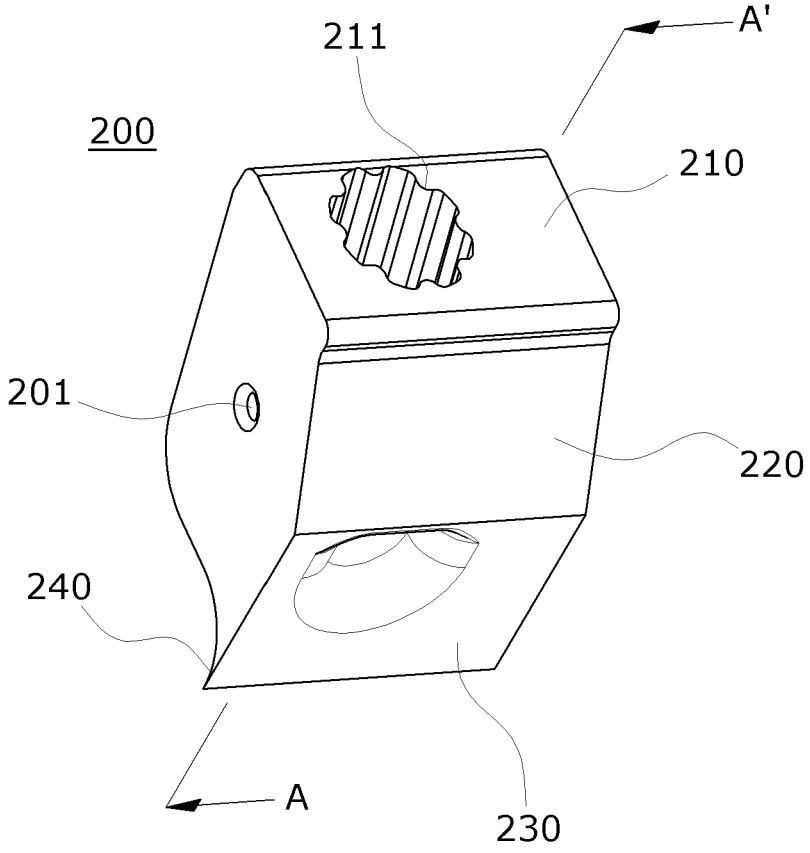
FIG. 3A is a perspective view illustrating the insulating member according to the exemplary embodiment of the present disclosure.
Figure 3B:
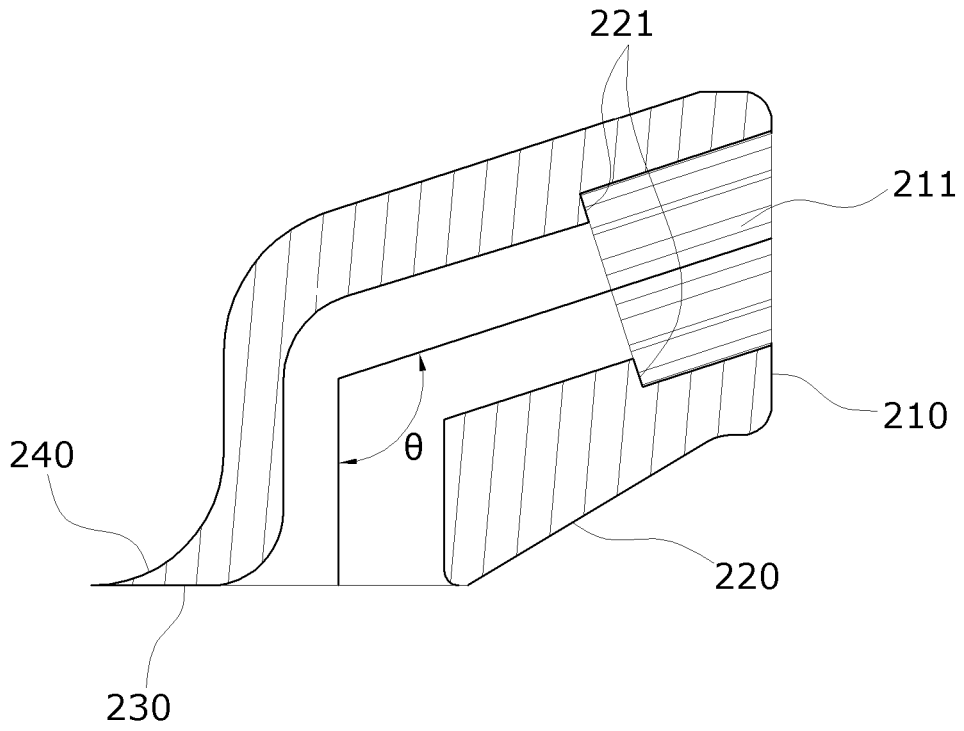
FIG. 3B is a cross-sectional view taken along line A-A' shown in FIG. 3A according to the exemplary embodiment of the present disclosure.
Figure 4:
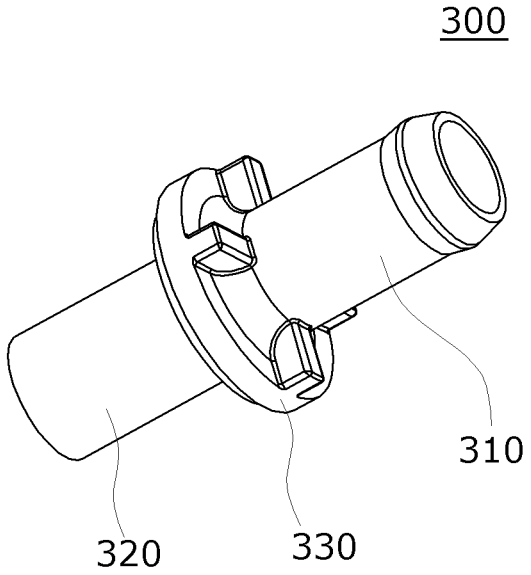
FIG. 4 is a perspective view illustrating the PCV nipple according to the exemplary embodiment.
Figure 5:
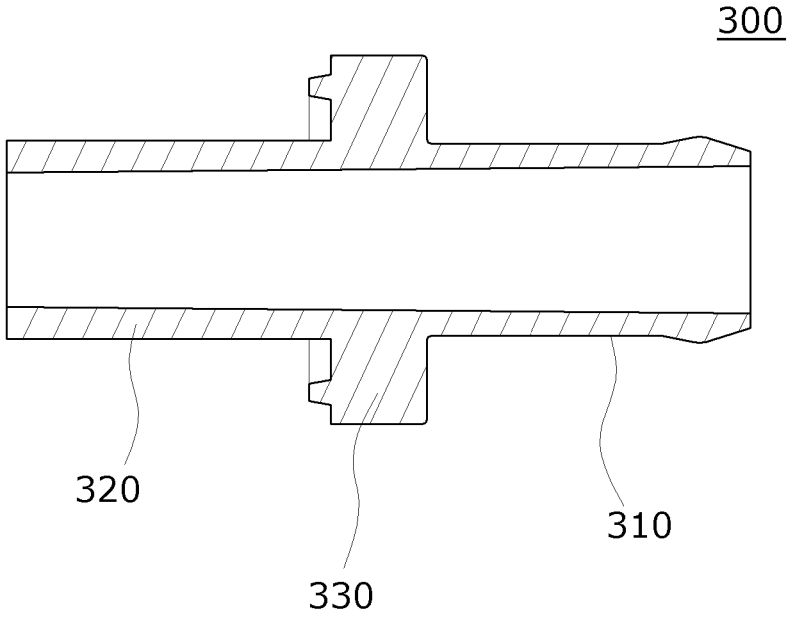
FIG. 5 is a cross-sectional view illustrating the PCV nipple according to the exemplary embodiment of the present disclosure.
Figure 6:
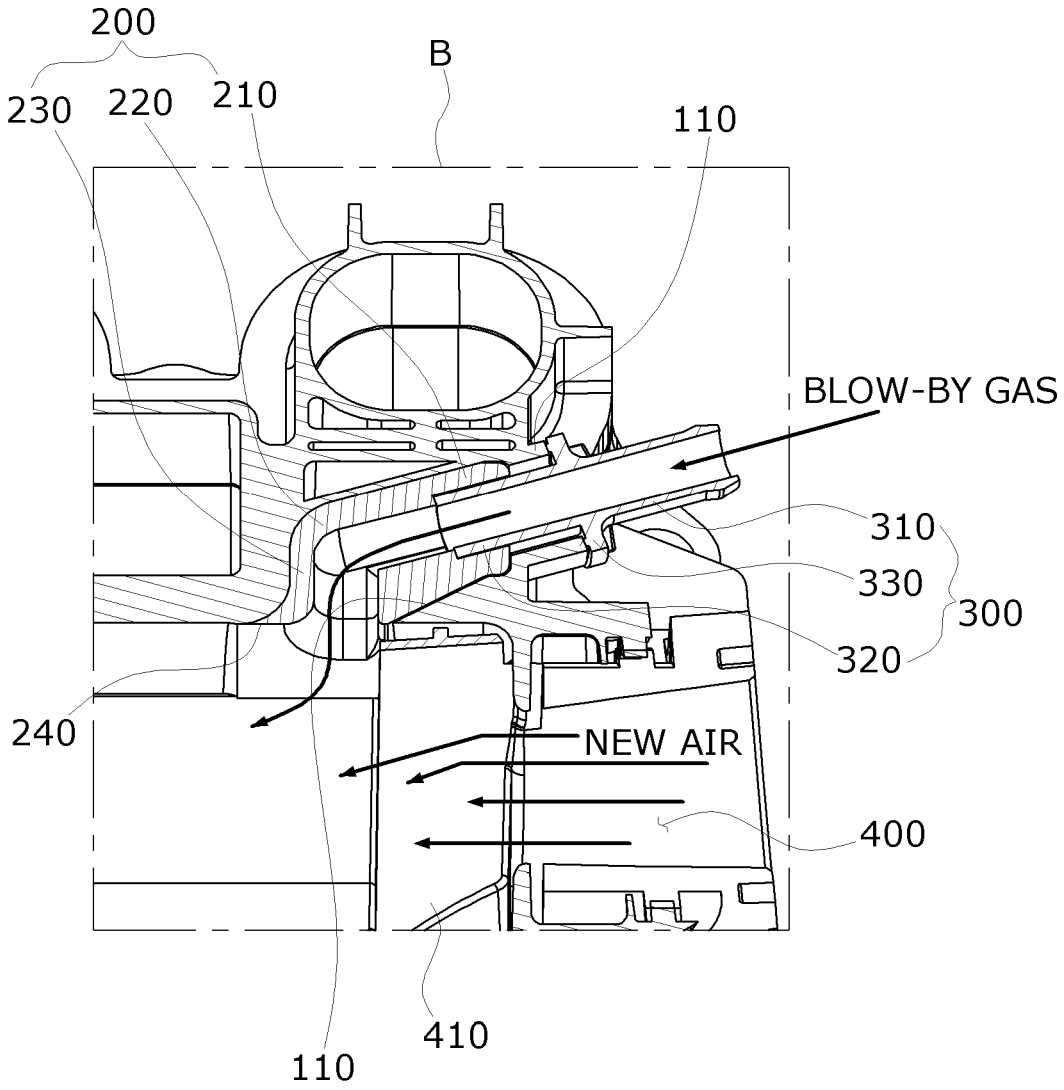
FIG. 6 is an enlarged view of portion "B" shown in FIG. 1 according to the exemplary embodiment of the present disclosure.

Hereinafter, exemplary embodiments of the present disclosure will be described in detail with reference to the accompanying drawings. FIG. 1 is a cross-sectional view illustrating a structure for preventing freezing of a blow-by gas in an intake manifold according to an exemplary embodiment of the present disclosure. FIG. 2 is an exploded perspective view illustrating a mounting structure of an insulating member and a positive crankcase ventilation (PCV) nipple according to the exemplary embodiment of the present disclosure. FIG. 3A is a perspective view illustrating the insulating member according to the exemplary embodiment of the present disclosure, and FIG. 3B is a cross-sectional view taken along line A-A' shown in FIG. 3A. FIG. 4 is a perspective view illustrating the PCV nipple according to the exemplary embodiment. FIG. 5 is a cross-sectional view illustrating the PCV nipple according to the exemplary embodiment of the present disclosure. FIG. 6 is an enlarged view of portion "B" shown in FIG. 1.

Referring to FIGS. 1 to 6, according to the exemplary embodiment of the present disclosure, the structure for preventing freezing of moisture contents within a blow-by gas in an intake manifold may include a PCV channel 100, an insulating member 200, a PCV nipple 300, and a guide panel 410. The structure may be applied to the intake manifold that includes a new air inlet 400 through which new air is introduced from outside, and thus, the blow-by gas discharged from a cylinder head of an engine and introduced into the intake manifold may be prevented from freezing.

The intake manifold according to the exemplary embodiment of the present disclosure may include a plurality of branch pipes each connected to an intake port of each cylinder and a surge tank commonly communicating with each branch pipe and having the new air inlet 400 formed in one side thereof, through which external air is introduced. Since the intake manifold has the same configuration as a known intake manifold for a vehicle, detailed descriptions thereof will be omitted.

The PCV channel 100 may be formed at a position adjacent to the new air inlet 400 in the intake manifold and allow the surge tank to communicate with the outside. Hereinafter, for convenience of description, a portion of the PCV channel 100, at which the surge tank is formed, is defined as an outlet side, and a portion of the PCV channel 100 that is disposed in an outward direction, i.e., disposed opposite to the portion at which the surge tank is formed, is defined as an inlet side. In the PCV channel 100, a blow-by gas may be introduced through the inlet side and discharged through the outlet side, and thus, introduced into the surge tank.

A fixing protrusion 110 may be formed in the PCV channel 100. The fixing protrusion 110 may extend in an outward direction from an outer side surface of the inlet side and may be configured to fix the PCV nipple 300 to the PCV channel 100. The insulating member 200 may include (e.g., made of or formed of) a polystyrene material. The insulating member 200 may be inserted into the PCV channel 100 in which the inlet side and the outlet side communicate with each other, and a first end and a second end of the insulating member 200 may communicate with each other. In addition, an outer peripheral surface of the insulating member 200 may be in contact with an inner peripheral surface of the PCV channel 100 and may be coupled therewith by a joining method such as, for example, a vibration welding method. As a result, the insulating member 200 may be fixed inside the PCV channel 100.

Further, a coupling protrusion 111 configured to fix the insulating member 200 may be formed in a region in which the insulating member 200 is disposed in the inner peripheral surface of the PCV channel 100. A coupling groove 201 may be formed at a position that corresponds to the coupling protrusion 111 in a side surface of the insulating member 200. The coupling protrusion 111 may be coupled to the coupling groove 201 when the insulating member 200 is inserted into the PCV channel 100. Therefore, the coupling protrusion 111 and the coupling groove 201 may fix the insulating member 200 to the PCV channel 100.

A shown in FIG. 3A, the insulating member 200 may include an insertion portion 210, a connection portion 220, and a discharge portion 230. The PCV nipple 300 into which a blow-by gas is introduced may be inserted into a first end of the insertion portion 210. An angle θ between the insertion portion 210 and the discharge portion 230 may be in a range of about 91° to about 105°. A support protrusion 211 may be formed in the insertion portion 210. A plurality of support protrusions 211 may be formed and extend in a radial direction at intervals from each other along an inner peripheral surface of the insertion portion 210. When the PCV nipple 300 is inserted into the insertion portion 210, an end of the support protrusion 211 may abut an outer peripheral surface of the PCV nipple 300 As a result, when the PCV nipple 300 is inserted into the insertion portion 210, the support protrusion 211 may prevent interference of the insulating member 200 and may guide an assembly reference position.

A first end of the connection portion 220 may extend from a second end of the insertion portion 210 opposite to the first end of the insertion portion 210 to which the PCV nipple 300 is inserted, and a second end of the connection portion 220 may be bent and extend in a downward direction from the first end thereof. The connection portion 220 may change a flow direction of the blow-by gas introduced through the PCV nipple 300 to a downward direction. Further, an inner diameter of the insertion portion 210 may be greater than an inner diameter of the connection portion 220. Accordingly, a stepped portion 221 may be formed between an inner peripheral surface of the insertion portion 210 and an inner peripheral surface of the connection portion 220 due to a difference between the inner diameters thereof. The stepped portion 221 may support a gas ejection portion 320 of the PCV nipple when the PCV nipple 300 is inserted into the insertion portion 210. As a result, the stepped portion 221 may prevent the PCV nipple 300 from being inserted excessively into the insertion portion and may allow a liquefied blow-by gas flowing down from the PCV nipple 300 to flow smoothly without being caught by the stepped portion 221.

A first end of the discharge portion 230 may extend from the second end of the connection portion 220, and a second end of the discharge portion 230 may extend in a downward direction from the first end thereof. The discharge portion 230 may guide the blow-by gas introduced through the PCV nipple 300 in a downward direction and subsequently discharge the blow-by gas to the outside of the insulating member 200. As shown in FIG. 3B, an edge region in a downward direction of the discharge portion 230 may be formed in a round shape. Therefore, when the blow-by gas discharged from the PCV nipple 300 is discharged from the discharge portion 230, the blow-by gas may be smoothly discharged due to the discharge portion 230.

The discharge portion 230 may include a latch protrusion 240 that extends in a radially outward direction from an outer peripheral surface of the second end of the discharge portion 230. The latch protrusion 240 may be integrally formed with the discharge portion 230 and disposed around the outlet side of the PCV channel 100 through which the blow-by gas is discharged. As a result, the latch protrusion 240 may prevent the insulating member 200 from being separated from the PCV channel 100 and may allow the insulating member 200 to be mounted at a particular position inside the PCV channel 100.

Further, the connection portion 220 disposed between the insertion portion 210 and the discharge portion 230 may include a curved inner peripheral surface as shown in FIG. 3B. Therefore, when the blow-by gas discharged from the PCV nipple 300 mounted in the insertion portion 210 collides against the inner peripheral surface of the connection portion 220, the blow-by gas may be effectively prevented from freezing on the inner peripheral surface of the connection portion 220 by smoothly guiding a flow of the blow-by gas. In addition, when a flow direction of the blow-by gas is changed by the connection portion 220, noise generated due to the blow-by gas colliding against the inner peripheral surface of the connection portion 220 may be reduced.

The PCV nipple 300 may be inserted into the insertion portion 210 of the insulating member 200, and a first end and a second end of the PCV nipple 300 may communicate with each other to guide the blow-by gas. The PCV nipple 300 may be inserted into the insertion portion 210 which is inclined by an angle of about 91° to about 105° from the discharge portion 230, and thus, the blow-by gas introduced through the PCV nipple 300 may be guided more easily and smoothly. In this case, the outer peripheral surface of the PCV nipple 300 may abut the inner peripheral surface of the insertion portion 210 of the insulating member 200, and thus, the insertion portion 210 of the insulating member 200 may surround the PCV nipple 300. As a result, a heat loss of the blow-by gas flowing into the PCV nipple 300 may be minimized to effectively prevent the blow-by gas from freezing inside the PCV nipple 300. In addition, the PCV nipple 300 may be used by adjusting a length thereof based on a specification of a product such as an intake manifold.

As shown in FIG. 4, the PCV nipple 300 may include a gas inflow portion 310, the gas ejection portion 320, and a fixing plate 330. The gas inflow portion 310 may be connected to a PCV hose connected to a cylinder head of an engine and include an aperture through which a blow-by gas is introduced from the PCV hose. The gas inflow portion 310 may be connected to the PCV hose, and thus, the gas inflow portion 310 may protrude to the outside of the intake manifold.

The gas ejection portion 320 may include an aperture through which the blow-by gas introduced from the gas inflow portion 310 is discharged. The gas ejection portion 320 may be inserted into the insertion portion 210 of the insulating member 200. Therefore, the blow-by gas introduced from the gas inflow portion 310 may be discharged through the gas ejection portion 320 and thus be moved inside the insulating member 200. In other words, the blow-by gas discharged from the gas ejection portion 320 may collide against the inner peripheral surface of the connection portion 220 of the insulating member 200 made of the polystyrene material, and thus, the blow-by gas may be more effectively prevented from freezing in a region in which a flow direction of the blow-by gas is changed, unlike the conventional case in which a blow-by gas comes into direct contact with an intake manifold.

As shown in FIG. 5, an inner diameter of the gas ejection portion 320 may be formed to be smaller than an inner diameter of the gas inflow portion 310. Accordingly, in the gas ejection portion 320 and the gas inflow portion 310, the blow-by gas introduced from the gas inflow portion 310 may be discharged at an increased speed to the outside through the gas ejection portion by a nozzle effect.

When the insulating member 200 and the PCV nipple 300 are mounted in the PCV channel 100, the insulating member 200 and the PCV nipple 300 may be gradually inclined in a downward direction from an inlet of the PCV nipple 300 to the gas ejection portion 320. A sectional shape of the PCV nipple 300 may also be inclined to correspond to an angle at which the insulating member 200 and the PCV nipple 300 are mounted. Therefore, the blow-by gas introduced into the PCV nipple 300 may be discharged at a higher speed through the gas ejection portion 320. In other words, since the blow-by gas introduced into the PCV nipple 300 is discharged at a higher speed, a residence time that the blow-by gas resides inside the PCV nipple 300 may be shortened as compared with the conventional case in which a gas inflow portion and a gas ejection portion of a PCV nipple have the same inner diameter and a PCV channel is horizontally formed, thereby more efficiently preventing the blow-by gas from freezing inside the PCV nipple 300.

In addition, since the blow-by gas discharged at the higher speed through the gas ejection portion 320 may collide against a curved inside surface of the connection portion 220 of the insulating member 200, a flow direction of the blow-by gas may be more smoothly diverted along the curved inside of the connection portion 220, and noise generated due to the blow-by gas colliding against the inner peripheral surface of the connection portion 220 may be more effectively reduced.

Furthermore, an outer diameter of the gas ejection portion 320 may be smaller than an inner diameter of the fixing protrusion 110. Therefore, when the gas ejection portion 320 is inserted into the insertion portion 210, a space may be formed between the outer peripheral surface of the PCV nipple 300 and the inner peripheral surface of the fixing protrusion 110. Accordingly, an air layer may be formed between the PCV nipple 300 and the fixing protrusion 110. The air layer between the PCV nipple 300 and the fixing protrusion 110 may provide thermal insulation and minimize a heat transfer, thereby preventing freezing of a blow-by gas flowing into the PCV nipple 300.

The fixing plate 330 may be formed on an outer peripheral surface of a middle region of the PCV nipple 300. The fixing plate 330 may extend in a radially outward direction from the outer peripheral surface of the middle region of the PCV nipple 300 and may be formed in a shape that substantially correspond to the fixing protrusion 110 of the PCV channel 100. The fixing plate 330 of the PCV nipple 300 and the fixing protrusion 110 of the PCV channel 100 may be coupled to each other by a method such as, for example, bolt coupling, vibration welding, or spin welding. However, the present disclosure is not limited thereto, and the fixing plate 330 and the fixing protrusion 110 may be coupled to each other by various other methods.

In addition, although a shape of the PCV channel 100 is changed according to a shape of the intake manifold, the insulating member 200 may surround the PCV nipple 300. When the insulating member 200 and the PCV nipple 300 is inserted into the PCV channel 100 to be inclined at a particular angle, a design of the insulating member 200 and the PCV nipple 300 may be changed such that the insulating member 200 and the PCV nipple 300 have a shape that corresponds to the changed shape of the PCV channel 100.

As shown in FIG. 6, the guide panel 410 may extend from an inner side surface of the new air inlet 400 to the surge tank and extend in a downward direction to be spaced apart from the discharge portion 230 of the insulating member 200. More specifically, the guide panel 410 may have a shape that is inclined at an angle of about 1° to about 30° from the inner side surface of the new air inlet 400 in a downward direction of an end of the insulating member 200. Due to the guide panel 410, the new air introduced from the new air inlet 400 may be smoothly introduced into the surge tank along an inclined surface of the guide panel 410.

In addition, the guide panel 410 may effectively block the new air from being directly introduced toward the discharge portion 230 of the insulating member 200. The new air introduced through the new air inlet 400 may be introduced into the surge tank more rapidly due to a pressure difference with a blow-by gas discharged to the discharge portion 230 of the insulating member 200. Correspondingly, according to the present disclosure, the blow-by gas and the new air may be mixed more rapidly, and the blow-by gas may be prevented from freezing by a front end of an inlet of the surge tank and the insulating member 200.

As described above, in the structure for preventing freezing of the blow-by gas in the intake manifold according to the present disclosure, since the latch protrusion 240 integrally formed with the discharge portion 230 of the insulating member 200 is disposed around the outlet side of the PCV channel 100 through which the blow-by gas is discharged, the insulating member 200 may be prevented from being separated from the PCV channel 100 and may be mounted at a particular position inside the PCV channel 100.

Since the outer peripheral surface of the PCV nipple 300 is in contact with the inner peripheral surface of the insertion portion 210 of the insulating member 200, and the insertion portion 210 of the insulating member 200 surrounds the PCV nipple 300, a heat loss of the blow-by gas flowing into the PCV nipple 300 may be minimized to prevent the moisture contents present in the blow-by gas from freezing inside the PCV nipple 300 more effectively.

In addition, the blow-by gas discharged from the gas ejection portion 320 may collide against the inner peripheral surface of the connection portion 220 of the insulating member 200 made of the polystyrene material, and thus, the blow-by gas may be prevented more effectively from freezing in a region in which a flow direction of the blow-by gas is changed.

Furthermore, since the inner diameter of the gas ejection portion 320 is smaller than the inner diameter of the gas inflow portion 310 and since the insulating member 200 and the PCV nipple 300 are gradually inclined downward from the inlet of the PCV nipple 300 to the gas ejection portion 320 when mounted in the PCV channel 100, the blow-by gas may be discharged at an increased speed through the gas ejection portion. Accordingly, a residence time that the blow-by gas passes inside the PCV nipple 300 may be decreased to prevent the blow-by gas from freezing inside the PCV nipple 300 more efficiently.

Since the blow-by gas discharged at the increased speed through the gas ejection portion collides against the curved inside of the connection portion 220 of the insulating member 200, a flow direction of the blow-by gas may be more smoothly diverted along the curved inside of the connection portion 220, and the noise generated due to the blow-by gas colliding against the inner peripheral surface of the connection portion 220 may be reduced more effectively.

In addition, since the guide panel 410 extends from the inner side surface of the new air inlet 400 and extends in a downward direction to be spaced apart from the discharge portion 230 of the insulating member 200, the new air introduced from the new air inlet 400 may be mixed with the blow-by gas guided along the guide panel 410 and discharged through the discharge portion and may subsequently be introduced into the surge tank more smoothly.

The present disclosure is not limited to the above-described exemplary embodiments and various modifications may be made without departing from the spirit and scope of the present disclosure.

What is claimed is:

1. A structure for preventing freezing of a blow-by gas in an intake manifold having a new air inlet through which new air is introduced from outside, comprising:

a positive crankcase ventilation (PCV) channel into which the blow-by gas is introduced;

an insulating member having a first side and a second side that communicate with each other, wherein the insulating member is inserted into the PCV channel; and a PCV nipple having a first end and a second end that communicate with each other, wherein the PCV nipple is inserted into the insulating member to guide the blow-by gas, wherein the insulating member includes an outer peripheral surface in contact with an inner peripheral surface of the PCV channel and an inner peripheral surface in contact with an outer peripheral surface of the PCV nipple to surround the peripheral surface of the PCV nipple, and wherein the insulating member includes a plurality of support protrusions formed on the inner peripheral surface that is in contact with the outer peripheral surface of the PCV nipple.

2. The structure of claim 1, wherein the PCV nipple includes:

a gas inflow portion configured to be connected to a PCV hose that is connected to a cylinder head of an engine and through which the blow-by gas is introduced; and a gas ejection portion through which the blow-by gas is discharged, wherein an inner diameter of the gas ejection portion is smaller than an inner diameter of the gas inflow portion.

3. The structure of claim 2, wherein the PCV nipple is gradually inclined in a downward direction from the gas inflow portion toward the gas ejection portion.

4. The structure of claim 3, wherein the insulating member includes:

an insertion portion having a first end in contact with an outer peripheral portion of the gas ejection portion;

a connection portion having a first end connected to a second end of the insertion portion and a second end that extends in the downward direction; and a discharge portion having a first end connected to the second end of the connection portion and a second end that extends in the downward direction, wherein the connection portion includes a curved inner peripheral surface.

5. The structure of claim 4, wherein the plurality of support protrusions are formed along an inner peripheral portion of the insertion portion.

6. The structure of claim 4, wherein an edge region in the downward direction of the discharge portion includes a round shape.

7. The structure of claim 4, wherein a stepped portion is formed in the insulating member between an inner peripheral surface of the insertion portion and an inner peripheral surface of the connection portion to support the gas ejection portion of the PCV nipple.

8. The structure of claim 4, wherein the insertion portion is inclined at an angle of about 91° to about 105° from the discharge portion.

9. The structure of claim 4, wherein an inlet side of the PCV channel, into which the blow-by gas is introduced, includes a fixing protrusion which extends in an outward direction from an outer side surface thereof, and the PCV nipple includes a fixing plate which extends in a radially outward direction from a middle region thereof to be mated with the fixing protrusion.

10. The structure of claim 9, wherein an inner diameter of the fixing protrusion is greater than an outer diameter of the gas ejection portion.

11. The structure of claim 9, wherein the fixing protrusion and the fixing plate are coupled to each other by bolt coupling, vibration welding, or spin welding.

12. The structure of claim 9, wherein a coupling protrusion configured to fix the insulating member is formed on an inner peripheral surface of the fixing protrusion, and a coupling groove is formed at a position that corresponds to the coupling protrusion in a side surface of the insulating member.

13. The structure of claim 4, wherein the discharge portion includes a latch protrusion which extends in an outward direction from an outer peripheral surface thereof and is disposed around an outlet side of the PCV channel through which the blow-by gas is discharged.

14. The structure of claim 13, wherein the insulating member is coupled inside the PCV channel by a vibration welding method.

15. The structure of claim 1, wherein the PCV channel further includes a guide panel which is formed at a position adjacent to the new air inlet in the intake manifold and extends from an inner side surface of the new air inlet in a downward direction to be spaced apart from an end of the insulating member.

16. The structure of claim 15, wherein the guide panel is inclined at an angle of about 1° to about 30° from the inner side surface of the new air inlet in the downward direction of the end of the insulating member.

17. A structure for preventing freezing of a blow-by gas in an intake manifold having a new air inlet through which new air is introduced from outside, comprising:

a positive crankcase ventilation (PCV) channel into which the blow-by gas is introduced;

an insulating member having a first side and a second side that communicate with each other, wherein the insulating member is inserted into the PCV channel; and a PCV nipple having a first end and a second end that communicate with each other, wherein the PCV nipple is inserted into the insulating member to guide the blow-by gas, wherein the insulating member includes an outer peripheral surface in contact with an inner peripheral surface of the PCV channel and an inner peripheral surface in contact with an outer peripheral surface of the PCV nipple to surround the peripheral surface of the PCV nipple, and wherein the PCV channel further includes a guide panel which is formed at a position adjacent to the new air inlet in the intake manifold and extends from an inner side surface of the new air inlet in a downward direction to be spaced apart from an end of the insulating member.

* * * * *